US012789245B2

(12) United States Patent
Ernst De La Graete

(10) Patent No.: US 12,789,245 B2
(45) Date of Patent: Nov. 10, 2026

(54) ROLLING MILL EQUIPPED WITH A DEVICE FOR ADJUSTING THE INCLINATION OF THE SPRAY BAR

(71) Applicant: FIVES DMS, Lezennes (FR)

(72) Inventor: Conrad Ernst De La Graete, Lezennes (FR)

(73) Assignee: FIVES DMS, Lezennes (FR)

( * ) Notice: Subject to any disclaimer, the term of this patent is extended or adjusted under 35 U.S.C. 154(b) by 238 days.

(21) Appl. No.: 18/407,777

(22) Filed: Jan. 9, 2024

(65) Prior Publication Data

US 2024/0226979 A1 Jul. 11, 2024

(30) Foreign Application Priority Data

Jan. 10, 2023 (FR) ..... 2300247

(51) Int. Cl.
*B21B 45/02* (2006.01)
*B21B 31/02* (2006.01)
(Continued)

(52) U.S. Cl.
CPC ..... *B21B 45/0233* (2013.01); *B21B 31/028* (2013.01); *B21B 31/28* (2013.01); *B21B 35/141* (2013.01); *B21B 1/0805* (2013.01); *B21B 2001/221* (2013.01); *B21B 2027/083* (2013.01); *B21B 2035/005* (2013.01)

(58) Field of Classification Search
CPC ..... B21B 2027/083; B21B 2027/103; B21B 45/0218; B21B 45/0233; B21B 31/028; B21B 31/28
See application file for complete search history.

(56) References Cited

U.S. PATENT DOCUMENTS 2,776,586 A 1/1957 Sendzimer
3,147,648 A * 9/1964 Sendzimir ..... B21B 31/26 72/43
(Continued)

FOREIGN PATENT DOCUMENTS

KR 20150089401 A 8/2015
KR 1020150089401 A 8/2015
(Continued)

OTHER PUBLICATIONS

French Search Report issued on Jul. 12, 2023, in corresponding French Application No. 2300247, 18 pages.
(Continued)

*Primary Examiner* — Edward T Tolan
(74) *Attorney, Agent, or Firm* — Maier & Maier, PLLC

(57) ABSTRACT

A rolling mill, in particular a cold rolling mill, including: rolls or even sets of rollers comprising at least one pair of work rolls capable of defining a roll gap of a strip to be rolled, at least one bar for spraying a lubricating and/or cooling fluid, disposed near the plane of the strip to be rolled, a stand inside of which the rolls are arranged, at least one device for adjusting the inclination of the at least one bar comprising an actuator, such as a hydraulic cylinder configured to change the inclination of the bar around the pivot axis. The actuator of the device for adjusting the inclination is arranged, on the second side of the stand, opposite to the first side of the maintenance window.

12 Claims, 5 Drawing Sheets

(51) Int. Cl.

| | |
|---|---|
| ***B21B 31/28*** | (2006.01) |
| ***B21B 35/14*** | (2006.01) |
| *B21B 1/08* | (2006.01) |
| *B21B 1/22* | (2006.01) |
| *B21B 27/08* | (2006.01) |
| *B21B 35/00* | (2006.01) |

(56) References Cited

U.S. PATENT DOCUMENTS 3,998,084 A * 12/1976 Rerecich ..... B21B 45/0218 72/201
4,272,976 A * 6/1981 Pizzedaz ..... B21B 27/10 72/236
4,905,493 A * 3/1990 Benedetti ..... B21B 13/001 72/239
5,558,017 A * 9/1996 Berger ..... B21B 31/20 72/250
5,715,720 A * 2/1998 Balve ..... B21B 39/16 72/239
10,449,583 B2 * 10/2019 Charre ..... B21B 45/0233
2016/0167097 A1 * 6/2016 Ernst De La Graete ..... B21B 45/0233 72/201

FOREIGN PATENT DOCUMENTS

WO 2015011373 A1 1/2015
WO 2016001541 A1 1/2016
WO 2018060580 A1 4/2018

OTHER PUBLICATIONS

Extended Search Report issued on Mar. 19, 2024, in corresponding European Application No. 24150741.7, 11 pages.

* cited by examiner

ROLLING MILL EQUIPPED WITH A DEVICE FOR ADJUSTING THE INCLINATION OF THE SPRAY BAR

The invention relates to a rolling mill, for example such as a cold rolling mill, and more particularly a 20-roll rolling mill, equipped with at least one spray bar, and a device for adjusting the inclination of the spray bar.

FIELD

The present disclosure lies in the field of such cold rolling mills, and more particularly a rolling mill known to a person skilled in the art by the name "20 High" or 20 "rolls".

BACKGROUND

Such a rolling mill, taught by the document U.S. Pat. No. 2,776,586, comprises a stand inside of which rolling rolls are arranged.

The rolling rolls comprise two work rolls defining the roll gap of the strip to be rolled, as well as a set of first intermediate rolls and a set of second intermediate rolls for the support of each work roll (lower and upper).

These rolling rolls are supported by several sets of rollers bearing on the second intermediate rolls, on either side of the plane of the strip to be rolled.

In a rolling mill of the "20 High" type, the first intermediate rolls are two in number, and said second intermediate rolls are three in number (for each work roll, upper or lower). Eight sets of rollers bear on the second intermediate rolls, on either side of the plane of the strip to be rolled.

It is moreover known to lubricate/cool the strip and/or the work rolls by spraying a cooling/lubricating fluid, in the upper part and in the lower part of the strip.

The projection of this fluid is typically ensured by spray bars, illustrated in the drawings of the document U.S. Pat. No. 2,776,586.

These bars extend over the width of the strip to be rolled, in the stand of the rolling mill, at an inter-space between the upper intermediate rolls, on the one hand, and the lower intermediate rolls, on the other hand. These bars are conventionally positioned near the work rolls.

Such rolling mills typically comprise two pairs of bars, the two bars of each pair being disposed respectively below and above the plane of the strip to be rolled. The two pairs of bars are disposed conventionally on either side of the rolling plane passing through the axes of the work rolls.

Each of the bars can be pivotably articulated on the stand, in order to allow the adjustment of the position of the bar with respect to the strip, or with respect to the nearby rolls. This adjustment is carried out by rotation of the bar about its pivot axis, substantially parallel to the plane of the strip and perpendicular to the direction of movement of the strip. For this purpose, each bar has a device for inclining the bar comprising a rotating shaft, mounted free in rotation, at its ends, in bearings rigidly connected to the stand. A hydraulic cylinder, connecting the stand and the shaft, allows to actuate the bar in rotation, then to firmly maintain the bar at the desired position.

The various possible positions of the bars can allow, in particular, to facilitate the removal of the rolls, by moving aside the bar(s) of the roll to be changed. The various position can also allow to facilitate the insertion of the strip between the work rolls. Thus, and for example, the bars of the pair located upstream, according to the direction of insertion of the strip, can be moved closer to one another in order to physically guide the end of the strip to be introduced at the roll gap of the work rolls, and the bars of the other pair can be moved aside in order to facilitate the take-up of the strip, downstream of the work rolls.

According to the observations of the applicant, and as taught by WO2018/060580, the cylinders and hoses of the inclination device are typically positioned with respect to the stand of the rolling mill, on the access window side of the rolling mill, from which the rolls can be extracted, and while the supply of the bar, in particular of a tubular shaft of the bar, can be carried out only on the opposite side and as taught by WO2018/060580. A rotating joint ensures the free rotation of the tubular shaft of the bar with respect to a device for supplying fluid, on the side opposite to the window, in order to allow the control in rotation of the bars around their tubular shaft by the cylinders of the inclination device, arranged on the access window side.

The document WO2016/001541 teaches an arrangement of the devices for inclining the spray bars, in particular of the cylinders and of the hoses associated with the hydraulic control of the cylinders, and according to a spatial arrangement at the maintenance window advantageously leaving, as much as possible, a clearance allowing an extraction of the rolls, advantageously without disassembling the cylinders and hoses of the inclination device.

According to the observations of the applicant, there is always a risk, during the extraction of a roll from the window, of catching on the hoses of the cylinders.

According to the observations of the inventor, in such a prior art, the disassembly of the bar is tedious and time-consuming: in particular it requires previously at least partly uncoupling the inclination device, in particular the cylinder, or even a control lever associated with the cylinder, and in order to free a clearance allowing to extract the bar axially through the maintenance window.

SUMMARY

The present disclosure improves the situation.

A rolling mill is proposed, in particular a cold rolling mill, comprising:

- rolls, or even sets of rollers comprising at least one pair of work rolls capable of defining a roll gap of a strip to be rolled,
- at least one bar for spraying a lubricating and/or cooling fluid, disposed near the plane of the strip to be rolled,
- a stand inside of which said rolls, or even the sets of rollers, are arranged, said stand comprising, on a first side, on the one hand, a maintenance window, through which the rolls, or even the sets of rollers, as well as said at least one bar, can be extracted during the maintenance, and on the other hand, a second side, opposite to the first side, comprising means for supplying the bar with fluid, or even motorisation means for driving the rolls,
- at least one device for adjusting the inclination of said at least one bar comprising,
- a mechanism for articulation between said at least one bar and said stand according to a pivot link, typically, having a pivot axis of rotation parallel to the plane of the strip to be rolled and perpendicular to the direction of movement of the strip, and
- an actuator, such as a hydraulic cylinder configured to change the inclination of the bar around the pivot axis.

According to the present disclosure, said actuator of the device for adjusting the inclination is arranged, on the second side of the stand, namely the side opposite to the first side of the maintenance window.

The features disclosed in the following paragraphs can, optionally, be implemented. They can be implemented independently of each other or in combination with each other:

the spray bar can comprise a tubular shaft provided with a fluid inlet connected via a removable connector between an open end of the tubular shaft and an open proximal end of a tube of the supply means arranged on the second side, and wherein the bar is configured to be uncoupled from the tube and extracted through the maintenance window, without uncoupling of the actuator of the device for adjusting the inclination of said at least one bar, in particular on the second side of the stand, and without uncoupling of the supply means, in particular of the tube from the stand in particular on the second side.

in particular, the tube can be coaxial to the tubular shaft, as well as to said pivot axis, and wherein the actuator connects the stand to a lever of the device for adjusting the inclination, the lever extending radially to the tube, said actuator being configured to cause the change in inclination of the bar around the pivot axis by a transmission of a rotary torque to the lever and to the tube of the supply means, said tube being constrained to rotate with the spray bar;

the tube can be coupled via a rotating joint to a non-rotating device for supplying fluid rigidly connected to the stand; said tube can be in particular connected by the connector to the tubular shaft of the bar, by being coupled in rotation to the bar, at the proximal end of the tube and while the distal end of the tube is coupled via the rotating joint to the non-rotating device for supplying fluid.

said removable connector between the proximal end of the tube and the tubular shaft can comprise a first coupling part rigidly connected to an end of the tubular shaft and a second coupling part rigidly connected to the proximal end of the tube, the first coupling part and the second coupling part being configured to couple by fitting together according to the direction of the pivot axis during the insertion of the spray bar, and uncouple during the extraction of the bar through the maintenance window;

the first coupling part and the second coupling part can be configured to ensure a transmission of the torque engendered by the actuator, between the tube and the tubular shaft around the pivot axis; for this purpose, the first coupling part and the second coupling part can have polygonal cross-sections, for example hexagonal.

the articulation mechanism comprises a first arm rigidly connected to a support of the stand, in a first state, which is articulated to the pivot via a first bearing ring at a first end of the tubular shaft of the spray bar, on the first side, and a second arm rigidly connected to the support is pivotably articulated via a second bearing ring to the tube and driven by the actuator, on the second side, said removable connector allowing the uncoupling of the bar and of the tube being arranged between the two arms consisting of the first arm and the second arm, and configured so as to allow the uncoupling and the extraction of the bar through the maintenance window, after passage into a second state of the first arm in which it is uncoupled from the support on the first side, and while the second arm remains coupled to the support on the second side of the stand;

the stand of the rolling mill comprises a lower stand part, transmitting a clamping stress to the lower rolls, including to the lower work roll, or even to said sets of lower rollers, and an upper stand part, independent, vertically movable with respect to the lower stand part transmitting a clamping stress to the upper rolls, including to the lower work roll, or even to said sets of upper rollers.

According to one embodiment, the stand can receive:

in the upper part, in particular inside the upper stand part of the rolling mill, the upper work roll, as well as two first upper intermediate rolls, three second upper intermediate rolls, and four upper backup roller sets, in the lower part, in particular inside the lower stand part of the rolling mill, the lower work roll, as well as two first lower intermediate rolls, three second lower intermediate rolls, and four lower backup roller sets.

According to one embodiment, the rolling mill can comprise a first lower bar and a second lower bar, intended to be arranged while being lower than the strip to be rolled, disposed preferably substantially symmetrically with respect to a clamping plane passing through the axes of the work rolls, lower and upper, said first bar and the second bar comprising protruding extensions directed towards each other, at least in at least one determined angular position of the first and second bars thus configured to support the upper work roll, during the opening of the stand by vertical movement of the upper stand part with respect to the lower stand part.

The means for supplying said bar with fluid are provided on the second side, the rolling mill being devoid of means for supplying fluid for the bar at the maintenance window, on the first side.

According to a second aspect the present disclosure relates to a method for maintenance of a rolling mill according to the present disclosure, comprising:

a step /B/ in which the extraction of a bar is carried out, without disassembly of the device for adjusting the inclination on the second side of the stand, including without disassembly of the actuator, in particular after separation of the removable connector between the end of the tubular shaft and the proximal end of the tube of the supply means.

According to one embodiment, step /B/ is preceded by the opening of the stand of the rolling mill by vertical movement of the upper stand part with respect to the lower stand part.

BRIEF DESCRIPTION OF THE DRAWINGS

Other features, details and advantages will appear upon reading the description described in detail below, and upon analysing the appended drawings, in which:

FIG. 1 is a view of the configuration of a 20-roll rolling mill, comprising, on the one hand, an upper group comprising a work roll, two first intermediate rolls, three second intermediate rolls, and four sets of upper backup rollers, and on the other hand, a lower group comprising a work roll, two first intermediate rolls, three second intermediate rolls, and four sets of lower backup rollers.

FIG. 2 is a partial view of a rolling mill stand in two parts, including a lower stand part, illustrated in the drawing, receiving the rolls and backup rollers of the lower group, as well as spray bars, configured in particular for the cooling of the strip, or even of the lower rolls in particular the lower work roll, the upper stand part being mobile with respect to the lower stand part (not illustrated).

FIG. 2*a* is a detail view of the second side, opposite to the first side of the maintenance window, illustrating the devices for adjusting the inclination associated with the two lower spray bars, first and second bar.

FIG. 3 is a detail view of a bar, articulated to a support fastened to the lower stand part via two arms, a first arm rigidly connected to the support articulated to the pivot via a first bearing ring at a first end of the tubular shaft of the bar, on the first side, and a second arm rigidly connected to the support and pivotably articulated via a second bearing ring to the tube coupled with the lever, said lever driven by the actuator, the removable connector arranged between the two arms, near the second arm, the connector allowing the uncoupling of the bar from the tube.

FIG. 4 is a cross-sectional view according to a plane passing through the pivot axis of the bar, illustrating more particularly the removable connector and the second arm, as well as the rotating joint between the distal part of the tube and the fixed supply device, a detail view illustrating the two parts having hexagonal cross-sections according to a detail view, the hexagonal cross-sections allowing a transmission of torque between them.

DETAILED DESCRIPTION

The drawings and the description below contain, in essence, elements of a certain nature. They can thus not only be used to better understand the present disclosure, but also contribute to its definition, if necessary.

The present disclosure relates to a rolling mill 1 in particular a cold rolling mill, comprising:

- rolls 12,13,14,15, or even sets of rollers A, B, C, D, E, F, G, H comprising at least one pair of work rolls 12 capable of defining the roll gap of a strip BM to be rolled,
- at least one bar 3 for spraying a lubricating and/or cooling fluid, disposed near the plane of the strip to be rolled,
- a stand 2 inside of which said rolls 12,13,14,15, or even the sets of rollers A, B, C, D, E, F, G, H, are arranged.

Figure 1:
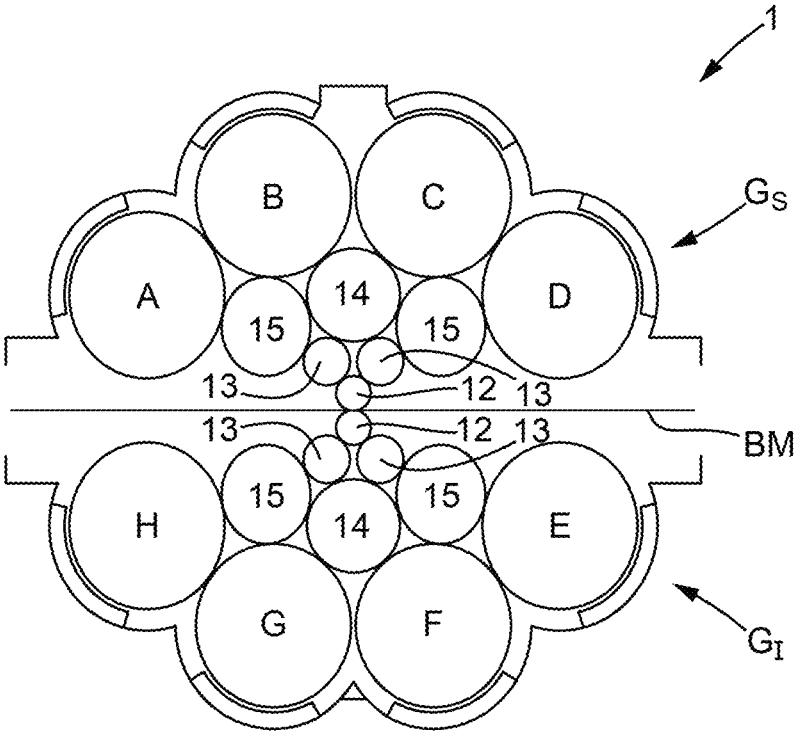
FIG. 1

In reference to FIG. 1, the present disclosure has a particular use in a rolling mill known to a person skilled in the art as a 20-roll or "20Hi" rolling mill, and in particular in such a rolling mill for which the stand is in two parts, usually called "split housing" by a person skilled in the art.

Such a stand 2 of the rolling mill in two parts comprises a lower stand part 20, transmitting a clamping stress to the lower rolls, including to the lower work roll 12, or even to said sets of lower rollers, and an upper stand part, vertically movable with respect to the lower stand part typically via hydraulic means transmitting a clamping stress to the upper rolls, including to the lower work roll, or even to said sets of upper rollers. Such a stand can be opened by moving away the upper stand part with respect to the lower stand part.

A 20-roll rolling mill conventionally comprises, as illustrated in FIG. 1:

- in the upper part, in particular inside the upper stand part of the rolling mill, the upper work roll 12, as well as two first upper intermediate rolls 13, three second upper intermediate rolls 14, 15, and four upper backup roller sets A, B, C, D,
- in the lower part, in particular inside the lower stand part of the rolling mill, the lower work roll 12, as well as two first lower intermediate rolls 13, three second lower intermediate rolls 14, 15, and four lower backup roller sets H, G, F, E.

The stand comprises, on a first side C1, on the one hand, a maintenance window W, through which the rolls 12, 13, 14, 15, or even the sets of rollers A, B, C, D, E, F, G, H, as well as said at least one bar 3, can be extracted during the maintenance, and on the other hand, a second side C2, opposite to the first side C1, provided with the means 4 for supplying the bar with lubricating/cooling fluid.

The rolling mill is preferably devoid of means for supplying fluid for the bar at the maintenance window, on the first side C1.

The rolling mill can further be provided with the motorisation means for driving the rolls on this second side C2.

The rolling mill can comprise a first lower bar 3*a* and a second lower bar 3*b*, arranged under the plane of movement of the strip BM, and configured for the cooling/the lubrication of the lower work roll 12, and a third bar, and a fourth bar for the cooling of the upper work roll, arranged above the strip BM configured for the lubrication of the upper work roll 12.

The two lower bars (first and second bar) or the two upper bars (third bar and fourth bar) are typically preferably distributed on either side of a clamping plane of the rolling mill, this plane passing through the axes of the two work rolls.

The rolling mill further comprises at least one device 5 for adjusting the inclination of said at least one bar, and typically:

- a first device for adjusting the inclination of the first bar 3*a*,
- a second device for adjusting the inclination of the second bar 3*b*,
- a third device for adjusting the inclination of the third bar (not illustrated),
- a fourth device for adjusting the inclination of the fourth bar (not illustrated).

The various possible positions of the bars can allow, in particular, to facilitate the removal of the rolls, by moving apart the bar(s) of the roll to be changed, and/or to ensure the take-up of the upper work roll by the first bar and the second bar.

Thus, and for example when the rolling mill comprises the first lower bar 3*a* and the second lower bar 3*b*, intended to be arranged below the strip to be rolled, preferably disposed substantially symmetrically with respect to a clamping plane passing through the axes of the lower and upper work rolls, said first bar and the second bar can comprise protruding extensions 9 directed towards each other, at least in at least one determined angular position of the first and second bars. These extensions 9 are configured to support the upper work roll 12, during the opening of the stand by vertical movement of the upper stand part with respect to the lower stand part.

The various positions can also allow to facilitate the insertion of the strip between the work rolls. Thus, and for example, the bars of the pair located upstream, according to the direction of insertion of the strip BM, can be moved closer to one another in order to physically guide the end of the strip to be introduced at the roll gap of the work rolls, and the bars of the other pair can be moved aside in order to facilitate the take-up of the strip, downstream of the work rolls.

Said at least one device 5 for adjusting the inclination of said at least one bar comprises:

a mechanism for articulation between said at least one bar and said stand 2 according to a pivot link, typically, having a pivot axis X3 of rotation parallel to the plane of the strip BM to be rolled and perpendicular to the direction of movement of the strip, and an actuator 50, such as a hydraulic cylinder VR configured to change the inclination of the bar around the pivot axis X3.

In particular, the rolling mill can comprise several independent inclination devices associated with the various bars, for example:

the first device for adjusting the inclination of the first bar comprises a first mechanism for articulation between said first bar and the stand and a first actuator, in particular a first cylinder, on the second side C2, the second device for adjusting the inclination of the second bar comprises a second mechanism for articulation between said second bar and the stand and a second actuator, in particular a second cylinder, on the second side C2, the third device for adjusting the inclination of the third bar comprises a third mechanism for articulation between said third bar and the stand and a third actuator, in particular a third cylinder, on the second side C2, the fourth device for adjusting the inclination of the fourth bar comprises a fourth mechanism for articulation between said fourth bar and the stand and a fourth actuator, in particular a fourth cylinder, on the second side C2.

Notably and according to the present disclosure, said actuator, in particular the cylinder, of said at least one device for adjusting the inclination is arranged on the second side C2 of the stand, opposite to the first side C1 of the maintenance window.

Disposing said actuator 50, such as the cylinder VR of the device for adjusting the inclination on the second side C2, advantageously allows to not encroach on the maintenance window W on the first side C1, and so as to facilitate the extraction of the rolls 12, 13, 14, 15, or even of the sets of rollers A, B, C, D, E, F, G, H through the maintenance window W. When the actuator in particular the cylinder includes one or more hydraulic hoses, the risks of tearing off of the hoses, which are located on the second side C2, and not on the first side C1 like in the prior art, are thus avoided.

Also, and at least according to one embodiment, such a positioning can allow to carry out the extraction of said at least one bar 3 (in particular first, second, third and fourth bar) through the maintenance window W, and advantageously without requiring the previous uncoupling of the actuator 50 (in particular first, second, third and fourth) and without requiring in general the uncoupling of the inclination device on the second side C2 of the stand 2.

The operations of uncoupling the spray bar(s) can thus be advantageously simplified and shortened with respect to the prior art which requires to provide the uncoupling of the actuator (namely the hydraulic cylinder) before the extraction of the bar 3 through the maintenance window W.

Thus and according to one embodiment, the spray bar 3 can comprise a tubular shaft 30 provided with a fluid inlet connected via a removable connector 6 between an open end of the tubular shaft 30 and an open proximal end of a tube 40 of the supply means 4 arranged on the second side C2.

The bar 3 is advantageously configured to be uncoupled from the tube 40 and extracted through the maintenance window 4, after uncoupling of the removable connector 6, without uncoupling of the actuator 50 of the device 5 for adjusting the inclination on the stand, on the second side C2 of the stand, and in particular without uncoupling of the supply means 4 from the stand 2, in particular on the second side C2.

According to one embodiment, the tube 40 is coaxial to the tubular shaft 30, as well as to said pivot axis X3. The actuator 50 connects the stand to a lever 51 of the adjustment device, extending radially to the tube 40, said actuator 50 being configured to cause the change in inclination of the bar 3 around the pivot axis X3 by a transmission of a rotary torque to the lever 51 and to the tube 40 of the supply means, constrained to rotate with the spray bar 3.

Figure 2:
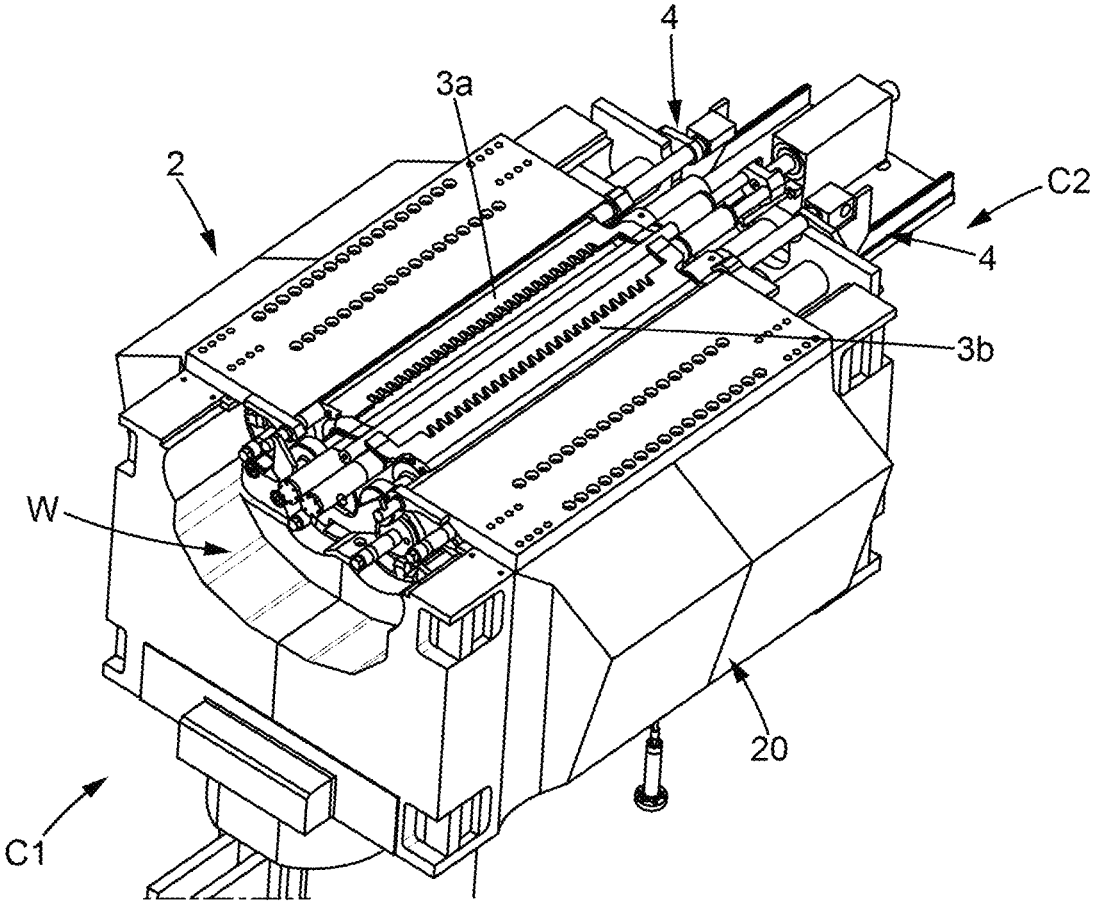
FIG. 2
Figure 2A:
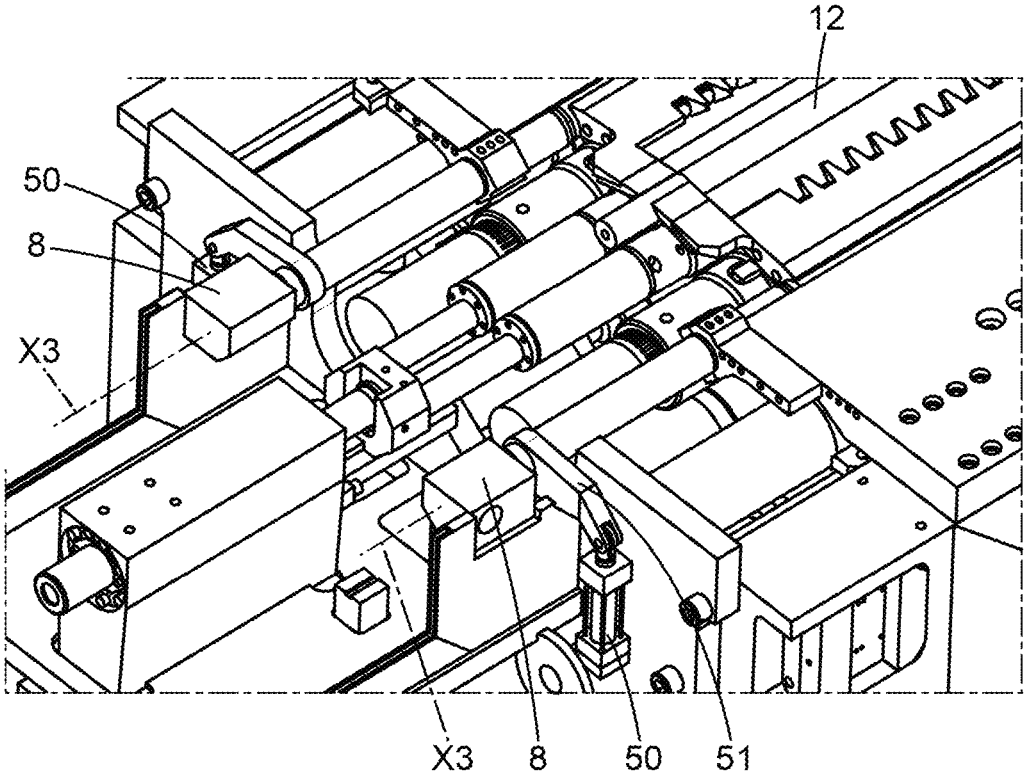
FIG. 2*a*
Figure 3:
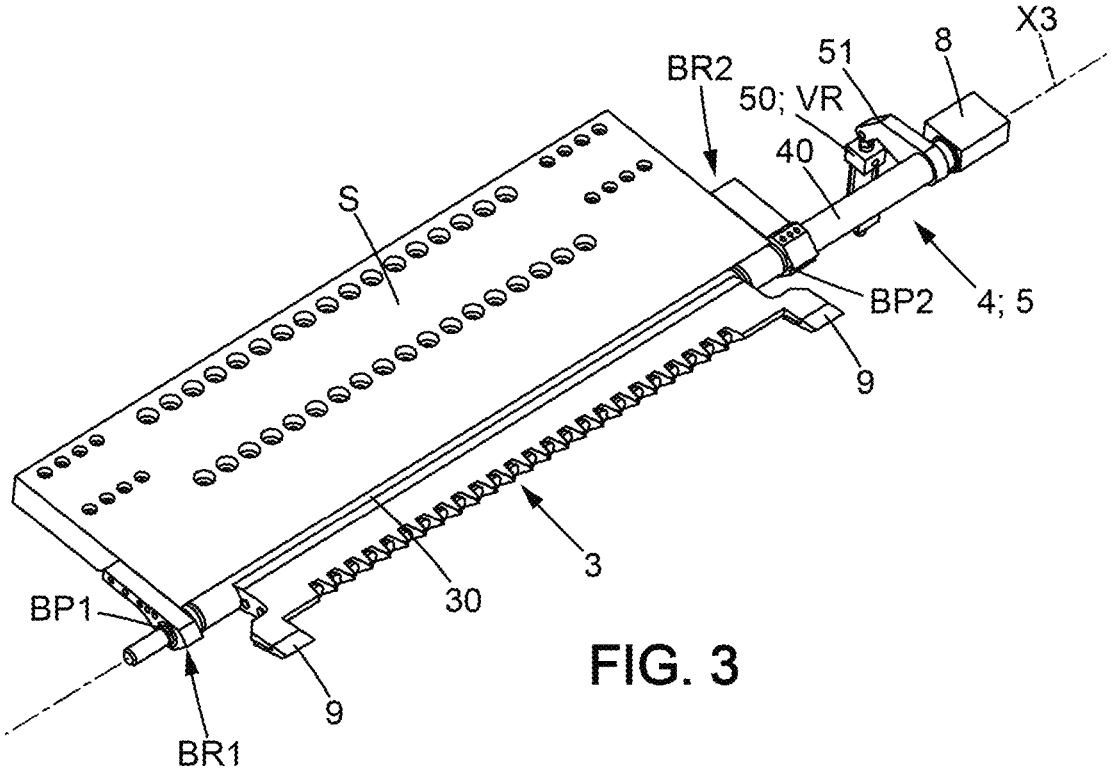
FIG. 3

Thus, and for example; in FIG. 2*a*, a first end of the actuator, in particular of the cylinder, is coupled via a first articulated link to the stand, and another end of the actuator, in particular of the cylinder, is coupled to the lever via a second articulated link, in particular at an end portion.

The deployment of the actuator 50 (or its retraction), in particular of the cylinder VR, engenders a torque that is transmitted to the lever and conjointly to the tube 40 which is rotationally coupled to the spray bar 3, which causes the rotation of the bar about the axis X3. The tube 40 thus has a primary function of supplying fluid for the bar, but also is an integral part of the device for adjusting the inclination in that it is an element for transmitting torque, between the actuator 50 on the one hand, and the bar 3 on the other hand.

It is noted that the tube 40 can be connected by the connector 6 to the tubular shaft 30 of the bar 3 by being rotationally coupled to the bar, at the proximal end of the tube 40. The distal end of the tube 40, opposite to that of the connector 6, can be driven in rotation by the actuator 50 during the adjustment, and coupled via a rotating joint 7 to a non-rotating device 8 for supplying cooling/lubricating fluid rigidly connected to the stand.

In particular for the lower bar(s), in the case of a stand 2 in two parts, the device 8 for supplying fluid is fastened to the lower stand part 20, and thus for the upper bar(s), the device 8 for supplying fluid, non-rotating, is fastened to the upper stand part, movable with respect to the lower stand part 20.

According to an advantageous embodiment, said removable connector 6 between the proximal end of the tube 40 and the tubular shaft 30 can comprise a first coupling part 60 rigidly connected to an end of the tubular shaft 30 and a second coupling part 61 rigidly connected to the proximal end of the tube 40.

The first coupling part 60 and the second coupling part 61 are configured to couple by fitting together according to the direction of the pivot axis X3 during the insertion of the spray bar 3 and uncouple during the extraction of the bar through the maintenance window.

According to such an embodiment, the coupling and the uncoupling of the two coupling parts (first part 60 and second part 61) can be carried out from the first side C1 of the stand, and without requiring the presence of an operator on the second side C2, which is not very accessible for an operator.

The first coupling part 60 and the second coupling part 61 can also be configured to ensure a transmission of the torque engendered by the actuator 5, between the tube 40 and the tubular shaft 30, around the pivot axis X3.

Figure 4:
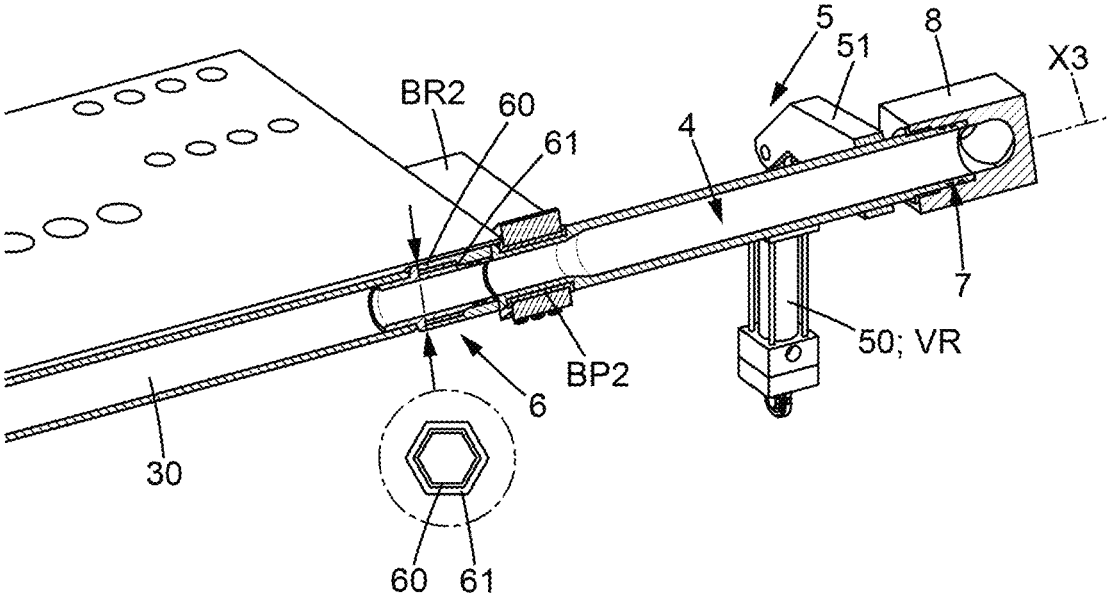
FIG. 4

For this purpose, the first coupling part 60 and the second coupling part 61 can have polygonal cross-sections, for example hexagonal, and be configured to ensure the transmission of torque, and as illustrated in the detail view of FIG. 4.

According to one embodiment, the articulation mechanism can comprise a first arm BR1 rigidly connected to a support S of the stand which, in a first state of the arm, is articulated to the pivot via a first bearing ring BP1 at a first end of the tubular shaft 30 of the spray bar 3, on the first side C1 of the stand 2, and a second arm BR2 rigidly connected to the support S which is pivotably articulated via a second bearing ring BP2 to the tube 40 driven by the actuator 50 on the second side C2.

The removable connector 6 allowing the uncoupling of the bar 3 and of the tube 40 can be arranged between the two arms, configured so as to allow the uncoupling and the extraction of the bar 2 through the maintenance window, after passage of the first arm BR1 into a second state for which said first arm is uncoupled from the support S on the first side C1, which is easily accessible from this first side C1 for the operator, and while the second arm BR2 remains advantageously coupled to the support S on the second side C2, not therefore requiring to be disassembled.

The present disclosure also relates to a method for maintenance of a rolling mill 1, comprising:

a step /B/ in which the extraction of the bar 3 is carried out, without disassembly of the device 5 for adjusting the inclination on the second side C2 of the stand, including without disassembly of the actuator 5, in particular after separation of the removable connector 6 between the end of the tubular shaft 30 and the proximal end of the tube 40 of the supply means 4.

According to one embodiment, the extraction of the bar 3 requires uncoupling the first arm BR1, on the first side of the stand, and advantageously without requiring any action on the opposite second side to disassemble the second arm BR2.

According to one embodiment, step /B/ is preceded by:

/A/Opening of the stand of the rolling mill by vertical movement of the upper stand part with respect to the lower stand part 20.

When the bar is inserted into the stand with a view to the connection of the tubular shaft 30 of the bar 3 to the supply means 4 in particular to the tube 40 by the removable connector 6, the connection to the supply means 4 on the second side C2 is obtained by simple fitting together, in particular between the two coupling parts (namely the first coupling part 60 and the second coupling part 61), and advantageously still without requiring the intervention of the operator on this second side C2 of the stand.

INDUSTRIAL APPLICABILITY

The present disclosure advantageously allows, first of all, to greatly free the maintenance window of any equipment related to the inclination of the bars, or related to the supply of the bars with fluid: the maintenance window thus freed therefore allows to greatly facilitate the operations of changing rolls or the sets of rollers, by eliminating for example the risks of the hoses of the cylinders catching, and as known in the prior art.

Moreover, and at least according to an advantageous embodiment, the rolling mill facilitates the operations of extraction or of insertion of the bar(s) per se, in that these operations do not require uncoupling of the actuator or of the lever, reducing the time of the operations of extraction or of insertion of the bars, and with respect to the known prior art which requires the uncoupling of the cylinders or even of the levers coupled to these cylinders.

The bar 3 in particular first, second, third and fourth can conventionally comprise a series of nozzles supplied with fluid and allowing the spraying of a curtain of fluid over the width of the metal strip to be rolled, or over the length of the work roll. This can in particular be for example a design as taught by WO2018/060580, and which is notable in that it guarantees a low dispersion of flow rates of the nozzles measured over the length of the bar, and even when the tubular shaft of the bar is supplied with fluid from a single one of its ends, in this case the end of the tubular shaft 30 pointing to the second side C2 of the stand, in the context of the present disclosure.

LIST OF THE REFERENCE SIGNS

: Rolling mill
2. Stand,
20. Lower stand part (the upper stand part is not illustrated),
3 Bar, in particular first bar 3*a* and second bar 3*b*,
4. Means for supplying fluid,
40. Tube,
5. Device for adjusting the inclination,
50. Actuator,
51. Lever,
6. Removable connector,
60. First coupling part,
61. Second coupling part,
7. Rotating joint,
8. Non-rotating supply device,
9. Extensions,
12. Work rolls (including upper and lower),
13. First intermediate rolls (including upper and lower),
14, 15. Second intermediate rolls (including upper and lower),
A, B, C, D. Set of upper rollers,
H, G, F, E. Set of lower rollers,
VR. Hydraulic cylinder.

The invention claimed is:

1. Rolling mill comprising:

rolls comprising at least one pair of work rolls capable of defining a roll gap of a strip to be rolled, at least one spray bar for spraying a lubricating and/or cooling fluid, disposed near a plane of the strip to be rolled, a stand inside of which said rolls, are arranged, said stand comprising, on a first side, a maintenance window, through which the rolls can be extracted during maintenance, and, a second side, opposite to the first side, comprising supply means for supplying the bar with fluid, and motorisation for driving the rolls, and at least one device for adjusting the inclination of said at least one bar comprising:

a pivot between said at least one bar and said stand according to a pivot link, having a pivot axis of rotation parallel to the plane of the strip to be rolled and perpendicular to the direction of movement of the strip, and an actuator which is a hydraulic cylinder configured to change an inclination of the bar around the pivot axis, wherein said actuator of the device for adjusting the inclination is arranged on the second side of the stand, wherein the at least one spray bar comprises a tubular shaft provided with a fluid inlet connected via a removable connector between an open end of the tubular shaft and an open proximal end of a tube of the supply means arranged on the second side, and wherein the bar is configured to be uncoupled from the tube and extracted through the maintenance window, without uncoupling of the actuator of the device for adjusting the inclination of said at least one bar and without uncoupling of the supply means from the stand, and wherein the tube is coaxial to the tubular shaft, as well as to said pivot axis, and wherein the actuator connects the stand to a lever of the adjustment device, extending radially to the tube, said actuator being configured to cause the change in inclination of the bar around the pivot axis by a transmission of a rotary torque to the lever and to the tube of the supply means, said tube being constrained to rotate with the spray bar.

2. The rolling mill according to claim 1, wherein the tube is coupled via a rotating joint to a non-rotating device for supplying fluid rigidly connected to the stand.

3. The rolling mill according to claim 1, wherein the removable connector between the proximal end of the tube and the tubular shaft comprises a first coupling part rigidly connected to an end of the tubular shaft and a second coupling part rigidly connected to the proximal end of the tube, the first coupling part and the second coupling part being configured to couple by fitting together according to the direction of the pivot axis during the insertion of the spray bar, and uncouple during the extraction of the bar through the maintenance window.

4. The rolling mill according to claim 3, wherein the first coupling part and the second coupling part are configured to ensure a transmission of the torque engendered by the actuator, between the tube and the tubular shaft according to the pivot axis.

5. The rolling mill according to claim 4, wherein the first coupling part and the second coupling part have polygonal cross-sections.

6. The rolling mill according to claim 1, wherein the pivot comprises a first arm rigidly connected to a support of the stand, in a first state, which is pivotably articulated via a first bearing ring at a first end of the tubular shaft of the spray bar, on the first side, and a second arm rigidly connected to the support is pivotably articulated via a second bearing ring to the tube and driven by the actuator, said removable connector allowing the uncoupling of the bar and of the tube being arranged between the two arms, said removable connector is configured so as to allow the uncoupling and the extraction of the bar through the maintenance window, after passage into a second state of the first arm in which it is uncoupled from the support on the first side, and while the second arm remains coupled to the support on the second side.

7. The rolling mill according to claim 1, wherein the stand of the rolling mill comprises a lower stand part, transmitting a clamping stress to the lower rolls, including a lower work roll, and sets of lower rollers, and an upper stand part, vertically movable with respect to the lower stand part transmitting a clamping stress to the upper rolls, including to a lower work roll, and sets of upper rollers.

8. The rolling mill according to claim 1, wherein the stand receives:

in the upper part, an upper work roll, as well as two first upper intermediate rolls, three second upper intermediate rolls, and four upper bearing roller sets, and in the lower part, the lower work roll, as well as two first lower intermediate rolls, three second lower intermediate rolls, and four lower bearing roller sets.

9. The rolling mill according to claim 8, comprising a first lower bar and a second lower bar, arranged while being lower than the strip to be rolled, disposed substantially symmetrically with respect to a clamping plane passing through the axes of the work rolls, lower and upper, said first bar and the second bar comprising protruding extensions directed towards each other, at least in at least one determined angular position of the first and second bars, configured to support the upper work roll, during the opening of the stand by vertical movement of the upper stand part with respect to the lower stand part.

10. The rolling mill according to claim 1, wherein the means for supplying a bar with fluid are provided on the second side, the rolling mill being devoid of means for supplying fluid for the bar at the maintenance window, on the first side.

11. A method for maintenance of a rolling mill according to claim 1, comprising:

a step /B/ in which the extraction of a bar is carried out, without disassembly of the device for adjusting the inclination of said bar on the second side of the stand, including without disassembly of the actuator.

12. The method for maintenance of a rolling mill according to claim 11, wherein the stand of the rolling mill in which the method is implemented comprises a lower stand part, transmitting a clamping stress to the lower rolls, including to the lower work roll, or even to said sets of lower rollers, and an upper stand part, vertically movable with respect to the lower stand part transmitting a clamping stress to the upper rolls, including to the lower work roll, or even to said sets of upper rollers, and wherein step /B/ is preceded by the opening of the stand of the rolling mill by vertical movement of the upper stand part with respect to the lower stand part.

* * * * *